US007735158B2

(12) United States Patent
Tsurumi

(10) Patent No.: US 7,735,158 B2
(45) Date of Patent: Jun. 15, 2010

(54) HELMET

(75) Inventor: Masayuki Tsurumi, Ryugasaki (JP)

(73) Assignee: Shoei Co., Ltd. (JP)

( * ) Notice: Subject to any disclaimer, the term of this patent is extended or adjusted under 35 U.S.C. 154(b) by 978 days.

(21) Appl. No.: 11/503,454

(22) Filed: Aug. 11, 2006

(65) Prior Publication Data

US 2007/0050894 A1 Mar. 8, 2007

(30) Foreign Application Priority Data

Aug. 19, 2005 (JP) ..... 2005-238806

(51) Int. Cl.
*A42B 1/06* (2006.01)
*A42B 1/08* (2006.01)
*A63B 71/10* (2006.01)

(52) U.S. Cl. ..... 2/410; 2/424; 2/425

(58) Field of Classification Search ..... 2/410, 2/411, 414, 422, 423, 424, 425, 9, 184.5
See application file for complete search history.

(56) References Cited

U.S. PATENT DOCUMENTS

| | | | | |
|---|---|---|---|---|
| 5,734,994 | A * | 4/1998 | Rogers | 2/411 |
| 6,105,172 | A * | 8/2000 | Shida | 2/171.3 |
| 6,263,513 | B1 | 7/2001 | Murakami | |
| 6,763,526 | B1 * | 7/2004 | Hong | 2/171.3 |
| 2004/0158914 | A1 * | 8/2004 | Tanaka | 2/410 |

* cited by examiner

*Primary Examiner*—Gary L Welch
*Assistant Examiner*—Amber R Anderson
(74) *Attorney, Agent, or Firm*—Jones Day

(57) ABSTRACT

A helmet which can ventilate the interior of a head protecting body well by a ventilator mechanism and can decrease the degree of injury or the like of a wearer that may increase by the presence of the ventilator mechanism. At least one of a plurality of attaching mechanisms that attach a cover member or air current deflecting member to the shutter attaching member of the ventilator mechanism includes an engaging projection portion and an engaging hole having a gap. The engaging projection portion is configured to be relatively pressed into the gap and then relatively inserted and held in the engaging hole through the gap.

17 Claims, 6 Drawing Sheets

HELMET

TECHNICAL FIELD

The present invention relates to a helmet which comprises a head protecting body to be worn on the head of a helmet wearer (to be merely referred to as a "wearer" in this specification) such as a motorcycle rider and in which a ventilator mechanism to ventilate the interior of the head protecting body is provided to the head protecting body.

BACKGROUND OF THE INVENTION

As a full-face-type helmet in which a ventilator mechanism is provided to a head protecting body to ventilate the interior of the head protecting body as described above, for example, one described in U.S. Pat. No. 6,263,513 is conventionally known. The full-face-type helmet of U.S. Pat. No. 6,263,513 comprises a head central/rear ventilator mechanism at a head central/rear region including the vertex region (the vertex region substantially opposes the vertex of the wearer) and the upper portion of the back head region (the back head region substantially opposes the back part of the head of the wearer) of the head protecting body.

The head central/rear ventilator mechanism provided to the helmet of U.S. Pat. No. 6,263,513 comprises:

(a) a pair of left and right shutter members which reciprocate to open/close vent ports, (b) three left, three right (a total of six) shutter attaching members respectively held at predetermined positions of the head protecting body to attach and hold the shutter members reciprocally, and (c) a cover/air current deflecting member held at a predetermined position on the outer surface of the head protecting body in order to cover the shutter members and shutter attaching members and to deflect an air current flowing relatively along the outer surface of an outer shell so as to stabilize the head protecting body.

In this case, the cover/air current deflecting member is attached and fixed to the outer surface of the head protecting body by adhesion with an adhesive or a double-sided tape, or by fastening with a screw or rivet. The shutter attaching members are attached and fixed to the head protecting body by fitting their fitting cylindrical portions in exhaust holes formed in the head protecting body.

In the head central/rear ventilator mechanism of U.S. Pat. No. 6,263,513, the shutter members can open/close the through holes (in other words, exhaust holes formed in the head protecting body) of the respective fitting cylindrical portions of the shutter attaching members. Therefore, in the helmet of U.S. Pat. No. 6,263,513, when necessary, internal air can be led from the interior of the head protecting body (that is, from the inner structure of the head protecting body itself and/or the head accommodating space of the head protecting body) to the outside. When the internal air is led out in this manner, the interior of the head protecting body can be ventilated well.

In the helmet of U.S. Pat. No. 6,263,513, in order that the cover/air current deflecting member covers well the shutter members and shutter attaching members configured to ventilate the interior of the head protecting body and deflects the air current well so as to stabilize the head protecting body well, a comparatively large projection portion and recess portion must be formed on the cover/air current deflecting member. Such a big projection portion projects outward from the outer surface of the head protecting body. Therefore, for example, if the helmet of U.S. Pat. No. 6,263,513 is used as an off-road driving helmet for a motocross where falling accidents occur comparatively often, when an unforeseen circumstance such as a fall of a motorcycle during driving occurs, the comparatively large projection portion on the cover/air current deflecting member may catch on the ground surface of the unpaved road or a wasteland. Then, the head protecting body of the helmet may not function to skid smoothly on the ground surface of the unpaved road or the wasteland substantially in the traveling direction of the motorcycle so as to moderate the degree of injury or the like of the wearer. Hence, in the case of the helmet of U.S. Pat. No. 6,263,513, for example, when the motorcycle falls, the degree of the injury of wearer may not be able to be moderated due to the presence of the head central/rear ventilator (particularly its cover/air current deflecting member).

SUMMARY OF THE INVENTION

The present invention has been made to solve the problem as described above of the helmet of U.S. Pat. No. 6,263,513, and has as its object to provide a helmet in which the interior of the head protecting body can be ventilated well and/or the air current can be deflected well by a head central/rear ventilator mechanism, a head rear ventilator mechanism, or any other ventilator mechanism, and the degree of injury or the like of the wearer that may increase due to the presence of the ventilator mechanism can be decreased as much as possible.

According to the first aspect of the present invention, there is provided a helmet comprising a head protecting body to be worn on a head of a helmet wearer to protect the head, the head protecting body being provided with a ventilator mechanism to ventilate an interior of the head protecting body, and at least one ventilator mechanism comprising a shutter member to open/close a vent hole, a shutter attaching member which is attached to an outer surface of the head protecting body so as to attach and hold the shutter member reciprocally, and a cover member which is attached to the shutter attaching member with a plurality of (e.g., two) attaching mechanisms (preferably recess-projection engaging mechanisms) so as to cover the shutter member and the shutter attaching member, wherein the at least one of the plurality of attaching mechanisms comprises a recess-projection engaging mechanism including an engaging projection portion and an engaging hole having a gap, and the engaging projection portion is configured to be relatively pressed into the gap and then relatively inserted and held in the engaging hole through the gap. According to one embodiment of the first aspect of the present invention, the cover member also preferably serves as an air current deflecting member which relatively deflects an air current, relatively flowing along the outer surface of the head protecting body, so as to stabilize the head protecting body.

According to the second aspect of the present invention, there is provided a helmet comprising a head protecting body to be worn on a head of a helmet wearer to protect the head, the head protecting body being provided with a ventilator mechanism to ventilate an interior of the head protecting body, and at least one ventilator mechanism comprising a shutter member to open/close a vent hole, a shutter attaching member which is attached to an outer surface of the head protecting body so as to attach and hold the shutter member reciprocally, and an air current deflecting member which is attached to the shutter attaching member with a plurality of (e.g., two) attaching mechanisms (preferably recess-projection engaging mechanisms) so as to relatively deflect an air current flowing relatively along the outer surface of the head protecting body, thereby stabilizing the head protecting body, wherein the at least one of the plurality of attaching mechanisms comprises a recess-projection engaging mechanism including an engaging projection and an engaging hole having a gap, and the engaging projection portion is configured to be relatively pressed into the gap and then relatively inserted and held in the engaging hole through the gap.

According to the above first and second aspects of the present invention, when the wearer puts on the helmet and drives on a motor cycle, the interior of the head protecting body can be ventilated well by the ventilator mechanism. Even when the motorcycle falls during driving and the cover member or air current deflecting member catches on the ground surface or the like, the degree of injury of the wearer that may increase due to the presence of the ventilator mechanism can be decreased as much as possible. According to the first aspect of the present invention, damages or contamination of the shutter member and shutter attaching member can be prevented effectively. According to one embodiment of the first aspect of the present invention and according to the above second aspect of the present invention, when the wearer puts on the helmet and drives on the motor cycle, the air current deflecting member relatively deflects the air current flowing relatively along the outer surface of the head protecting body. Thus, the head protecting body can be stabilized.

According to the above first and second aspects of the present invention, the engaging projection portion can be formed on one (e.g., the shutter attaching member) of the shutter attaching member and the cover member or air current deflecting member, and the engaging hole can be formed in a remaining one (e.g., the cover member or air current deflecting member) of the shutter attaching member and the cover member or air current deflecting member.

According to the above first and second aspects of the present invention, at least another one of the plurality of attaching mechanisms can comprise a simple plug-in recess-projection engaging mechanism including a second engaging projection portion and a second engaging hole in which the second engaging projection portion is to be relatively inserted and held, the second engaging projection portion which is relatively inserted and held in the second engaging hole is configured to readily come out from the second engaging hole substantially in a direction of depth of the second engaging hole, and the second engaging projection portion is configured to relatively come out from the second engaging hole substantially in the same direction as a direction in which the engaging projection portion relatively comes out from the engaging hole through the gap. With this arrangement, when the wearer puts on the helmet and drives on the motor cycle, if the motorcycle falls and the cover member or air current deflecting member catches on the ground surface or the like, the cover member or air current deflecting member can be effectively removed from the head protecting body with a comparatively simple arrangement.

According to the above first and second aspects of the present invention, the plurality of attaching mechanisms can comprise two attaching mechanisms, one of the two attaching mechanisms can comprise the recess-projection engaging mechanism having the engaging projection portion and the engaging hole, and a remaining one of the two attaching mechanisms can comprise the simple plug-in recess-projection engaging mechanism.

According to the above first and second aspects of the present invention, preferably, the cover member or air current deflecting member has a substantially end-lug-hole-shaped engaging opening comprising the engaging hole, the gap, and an engaging auxiliary hole which continues to the engaging hole through the gap and is larger than the engaging hole, the cover member or air current deflecting member has a cover portion which covers the engaging auxiliary hole, and an inner surface of the cover portion decreases to gradually taper from the gap side of the engaging auxiliary hole toward an opposite side. With this arrangement, when the cover member or air current deflecting member is to be removed in the above manner, the cover portion is relatively separated from the engaging projection portion effectively. Thus, the cover member or air current deflecting member can be removed further effectively.

According to the above first and second aspects of the present invention, the cover portion can substantially form a ¼ spindle shape which can be obtained by halving a substantially spindle-shaped hollow body in both a longitudinal direction and a direction of diameter. According to the above first and second aspects of the present invention, a flexural rigidity of a material that forms the engaging projection portion preferably falls within a range of 30 MPa to 80 MPa and more preferably within a range of 40 MPa to 60 MPa. With this arrangement, the engaging projection portion can be relatively inserted in the engaging hole through the gap or can be relatively pulled out from the engaging hole through the gap effectively.

According to the above first and second aspects of the present invention, the cover member or air current deflecting member can have a ridge portion extending substantially in a back-and-forth direction substantially throughout an entire length of the cover member or air current deflecting member. According to the above first and second aspects of the present invention, the cover member or air current deflecting member can have a substantially two-way step portion which substantially opens backward. According to the above first and second aspects of the present invention, the substantially two-way step portion may comprise a substantially U-shaped step portion.

According to the above first and second aspects of the present invention, the cover member or air current deflecting member can further comprise a low-level surface which is substantially surrounded by the two-way step portion, and the low-level surface can have a vent port corresponding to the vent hole. According to the above first and second aspects of the present invention, the cover portion can be formed on the low-level surface substantially behind the vent port. According to the above first and second aspects of the present invention, the engaging projection portion can form a male-hook-like shape. According to the above first and second aspects of the present invention, the engaging projection portion can have a hollow structure. Furthermore, according to the above first and second aspects of the present invention, the engaging projection portion can be configured to be relatively pressed into and held by the engaging hole.

The above, and other, objects, features and advantages of this invention will become readily apparent from the following detailed description thereof which is to be read in connection with the accompanying drawings.

DETAILED DESCRIPTION OF THE INVENTION

An embodiment in which the present invention is applied to an off-road driving full-face-type helmet will be described in "1. General Description of Helmet as a Whole" and "2. Specific Description of Head Rear Ventilator Mechanism" with reference to the accompanying drawings.

1. General Description of Helmet as a Whole

Figure 1:
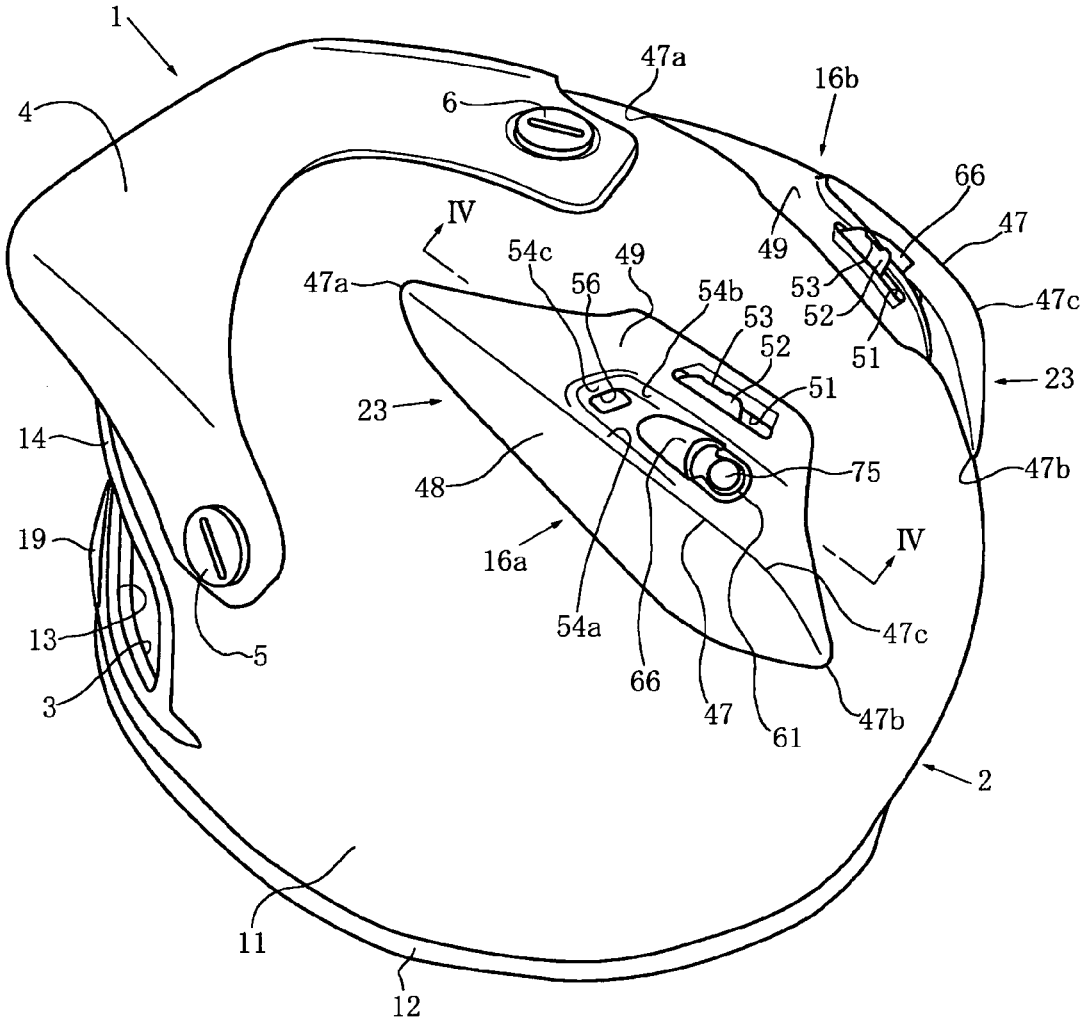
FIG. 1 is a schematic perspective view, seen from obliquely above the left rear side, of a helmet as a whole of an embodiment in which the present invention is applied to an off-road driving full-face-type helmet.
Figure 2:
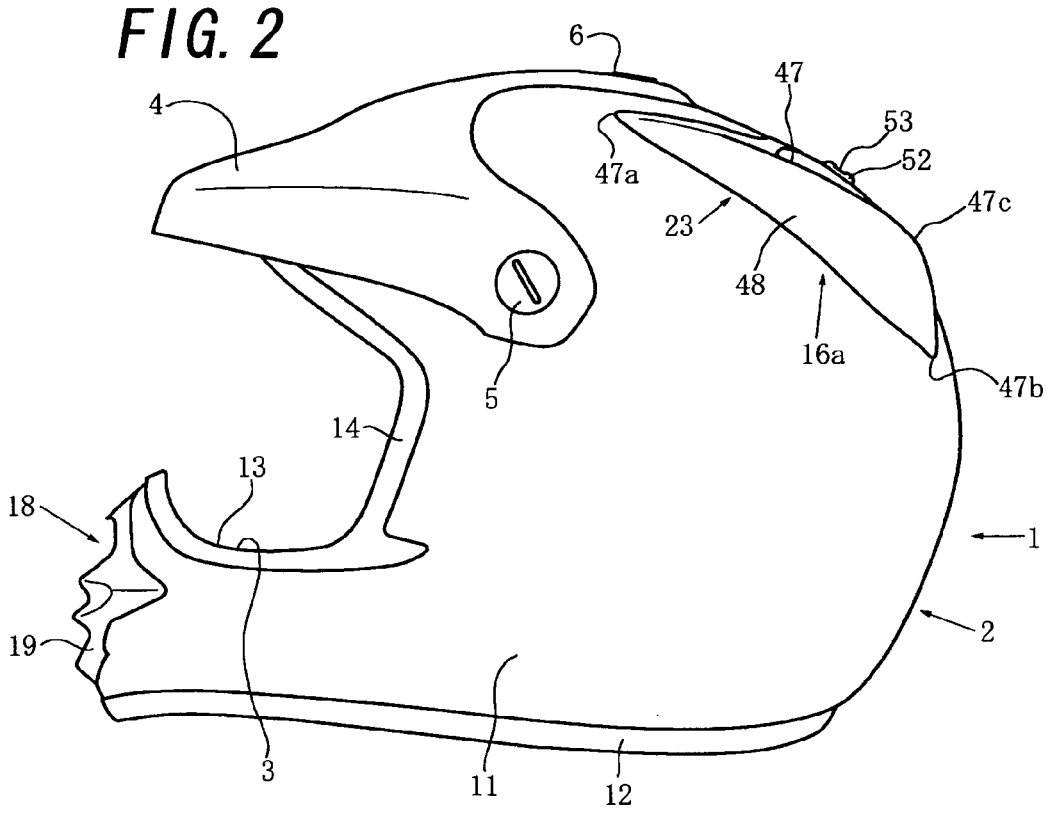
FIG. 2 is a left side view of the helmet shown in FIG. 1.
Figure 3:
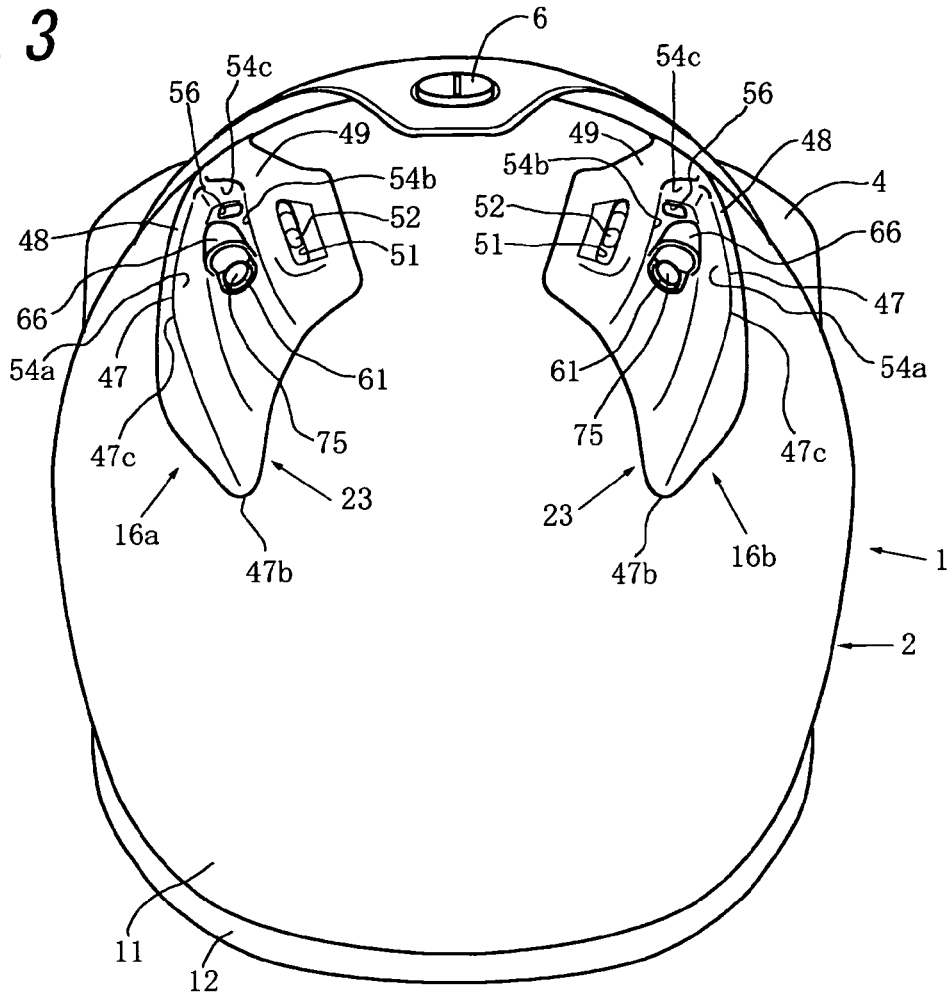
FIG. 3 is a rear view of the helmet shown in FIG. 1.

As shown in FIGS. 1 to 3, an off-road driving full-face-type helmet 1 such as a motocross helmet includes a full-face-type cap-like head protecting body 2 to be worn on the head of a wearer, a window opening 3 formed in the front surface of the head protecting body 2 to oppose a portion (i.e., the face) between the forehead and chin of the wearer, a visor 4 which projects forward above the window opening 3 from the head protecting body 2, and a pair of left and right chin straps (not shown) attached to the inside of the head protecting body 2. As has been known, the visor 4 can be made of an opaque, translucent, or transparent soft material such as polyethylene or another soft synthetic resin, and is attached and fixed to the head protecting body 2 with a pair of left and right attaching screws 5 and a central attaching screw 6.

As shown in FIGS. 1 to 3 and as has been known, the head protecting body 2 basically includes:

(a) a full-face-type outer shell 11 which forms the outer circumferential wall of the head protecting body 2, (b) a lower rim member 12 which has a substantially U-shaped section or the like and is attached to the outer shell 11 throughout substantially the entire periphery of the lower end portion of the outer shell 11 by, e.g., adhesion with an adhesive, a double-sided tape, or the like, (c) a window opening rim member 14 which has a substantially U- or E-shaped section or the like and is attached to a window opening 13, formed in the outer shell 11 to form the window opening 3 of the head protecting body 2, throughout substantially the entire periphery of the window opening 13 by, e.g., adhesion with an adhesive, a double-sided tape, or the like, (d) a backing member 15 (see FIG. 4) for the head which is attached inside the outer shell 11 by, e.g., adhesion with an adhesive, a double-sided tape, or the like in contact with the inner surface of the outer shell 11 in a front head region, a vertex region, left and right side head regions and a back head region substantially respectively opposing the front part, vertex, left and right parts and back part of the head of the wearer, (e) a backing member for the chin and cheek (not shown) which is attached inside the outer shell 11 by, e.g., adhesion with an adhesive, a double-sided tape, or the like in contact with the inner surface of the outer shell 11 in a chin region and cheek region substantially respectively opposing the chin and cheek of the wearer, and (f) a pair of left and right head rear ventilator mechanisms **16*a* and 16*b* which are abutted against the outer surface of the head protecting body 2** in the head rear region substantially opposing the head rear side of the wearer and attached there with screws or the like.

As has been known, the outer shell 11 shown in FIGS. 1 to 3 can be made of a composite material formed by lining the inner surface of a strong shell main body made of a hard material, e.g., FRP or another hard synthetic resin with a flexible sheet such as porous unwoven fabric. As has been known, the lower rim member 12 can be made of a soft material, e.g., foamed vinyl chloride, synthetic rubber, or another soft synthetic resin. As has been known, the window opening rim member 14 can be made of a highly flexible elastic material such as synthetic rubber.

As has been known, the backing member 15 for the head includes a substantially cap-shaped impact-on-the-head absorbing liner 17 (see FIG. 4) and a permeable backing cover (not shown) for the head which is attached to the impact-on-the-head absorbing liner 17 so as to cover substantially the entire inner surface of the impact-on-the-head absorbing liner 17. As has been known, the backing member for the chin and cheek includes a substantially semi-annular impact-on-the-chin-and-cheek absorbing liner (not shown) and a pair of left and right blockish inside pads (not shown) for the cheeks which are attached to the impact-on-the-chin-and-cheek absorbing liner in contact with the inner surface of the liner in two, left and right cheek regions substantially respectively opposing the two, left and right cheeks of the wearer.

Figure 4:
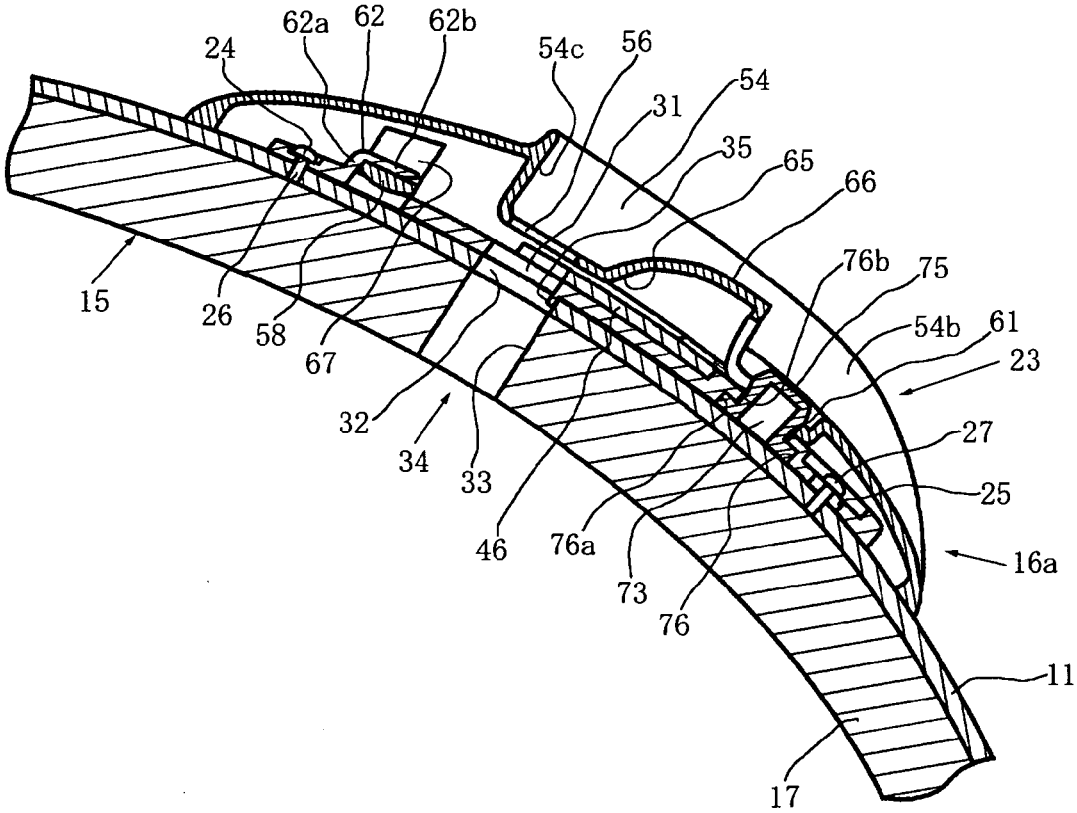
FIG. 4 is a sectional view taken along the line IV-IV of FIG. 1.

As has been known, the liner main body portion of the impact-on-the-head absorbing liner 17 shown in FIG. 4 and the liner main body portion of the impact-on-the-chin-and-cheek absorbing liner can be made of a material with appropriate rigidity and appropriate plasticity such as foamed polystyrene or another synthetic resin. As has been known, the backing cover for the head can be made of a combination of sheet materials such as woven fabric or porous unwoven fabric formed by laminating layers, having appropriate shapes and made of a highly flexible elastic material such as urethane foam or another synthetic resin, on a surface (i.e., the outer surface) which opposes the impact-on-the-head absorbing liner 17, or two side surfaces.

As shown in FIG. 2, the head protecting body 2 is provided with a chin ventilator mechanism 18 to substantially correspond to the chin region of the backing member for the chin and cheek. In FIG. 2, reference numeral 19 denotes a vent port forming member attached to the outer shell 11 with a screw or the like. One or plural vent ports (not shown) are formed in the vent port forming member 19. When necessary, a shutter member (not shown) is provided to open/close the vent port. When necessary, the head protecting body 2 may be provided with a front head ventilator mechanism (not shown) which substantially corresponds to a region comprising the front head region and its vicinity of the backing member 15 for the head (see FIG. 4).

2. Specific Description of Head Rear Ventilator Mechanism

As shown in FIGS. 1 to 3, the pair of left and right head rear ventilator mechanisms **16*a* and 16*b*** are respectively provided to the left and right sides of the head rear region which includes the rear portion of the vertex region (the vertex region substantially opposes the vertex of the wearer) and the upper portion of the back head region (the back head region substantially opposes the back part of the head of the wearer)

of the head protecting body 2. The pair of left and right head rear ventilator mechanisms 16*a* and 16*b* shown in FIGS. 1 to 3 is symmetrical to each other. Hence, in the following description, the left-side head rear ventilator mechanism 16*a* will be mainly described in detail in "(1) Arrangement of Head Rear Ventilator Mechanism" and "(2) Operation of Head Rear Ventilator Mechanism" with reference to FIGS. 4 to 6, and a specific description on the right-side head rear ventilator mechanism 16*b* will be omitted when necessary.

(1) Arrangement of Head Rear Ventilator Mechanism

Figure 5:
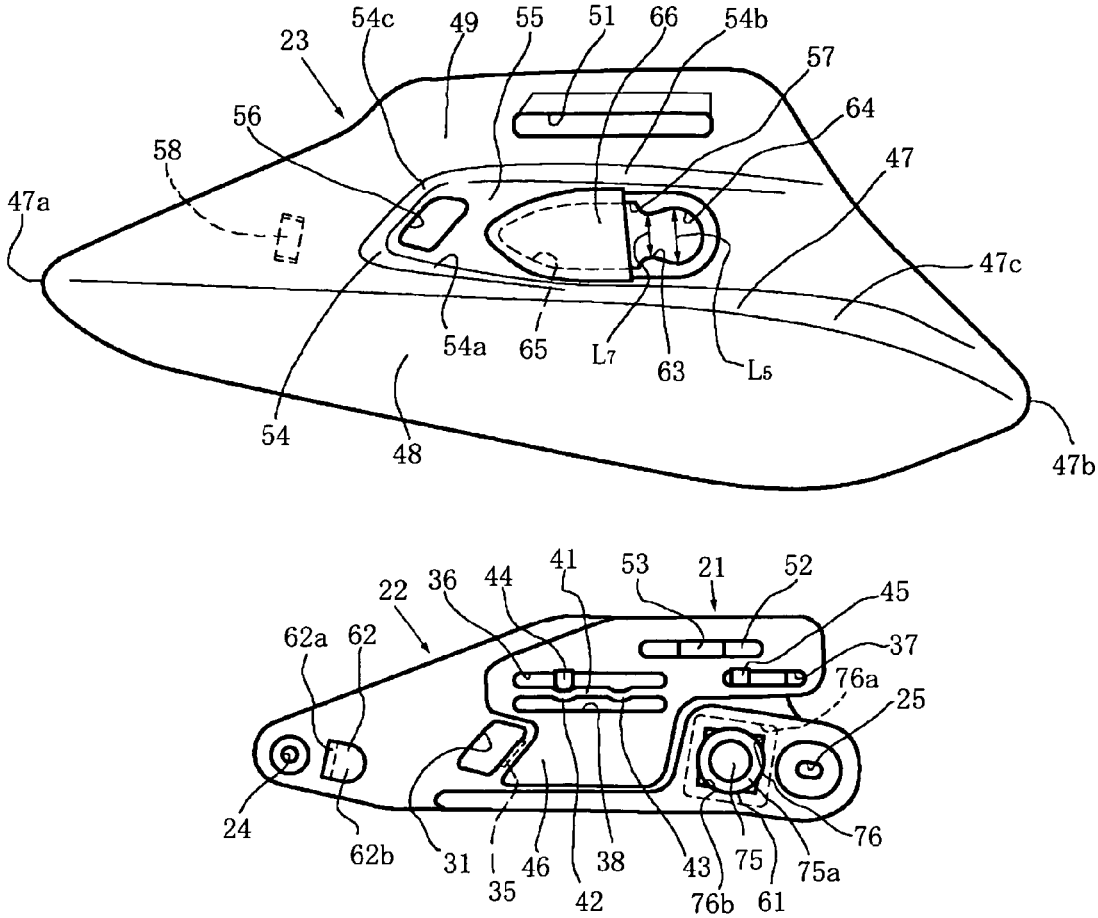
FIG. 5 is a plan view of the left-side head rear ventilator mechanism shown in FIG. 3 in a state wherein a cover member serving also as an air current deflecting member is separated from a shutter attaching member with a shutter member.
Figure 6:
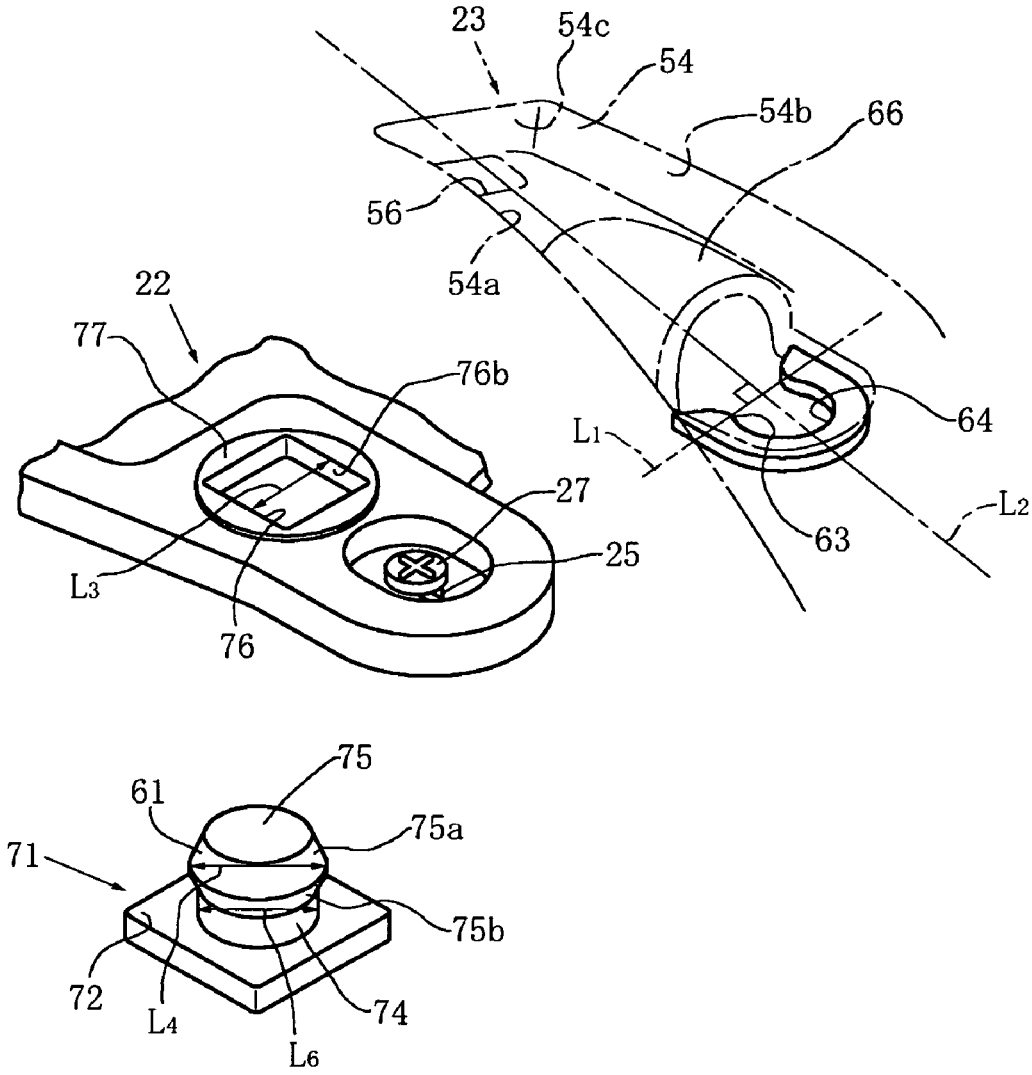
FIG. 6 is a perspective view of an engaging projection member, an attaching opening and its near portion, and an engaging opening and its near portion in a state wherein the engaging projection member for the shutter attaching member in the left-side head rear ventilator mechanism shown in FIG. 5 is separated from the engaging opening of the cover member serving also as the air current deflecting member and from the attaching opening of the shutter attaching member.

The left-side head rear ventilator mechanism 16*a* shown in FIGS. 4 to 6 may basically comprise:

(a) a substantially flat plate-shaped shutter member 21 which reciprocates linearly to open/close the vent port, (b) a substantially flat plate-shaped shutter attaching member 22 which is held at a predetermined position on the outer surface of the head protecting body 2 to attach and hold the shutter member 21 reciprocally, and (c) a substantially plate-like cover member 23 serving also as an air current deflecting member which is held at a predetermined position on the outer surface of the head protecting body 2 so as to cover the shutter member 21 and shutter attaching member 22 and deflect the air current flowing relatively along the outer surface of the outer shell 11 so as to stabilize the head protecting body 2.

Each of the shutter member 21, shutter attaching member 22 and cover member 23 may be made of a material having appropriate elasticity and appropriate rigidity, e.g., polycarbonate, polyacetal, ABS, nylon, or another synthetic resin. As shown in FIGS. 4 and 5, screw insertion holes 24 and 25 are respectively formed in a region comprising the front end portion and its vicinity, and a region comprising rear end portion and its vicinity of the shutter attaching member 22. Either one (in the case shown in the drawings, the screw insertion hole 25 on the rear end portion side) of the screw insertion holes 24 and 25 may be an elongated hole extending substantially in the back-and-forth direction. Attaching screws 26 and 27 respectively inserted in the screw insertion holes 24 and 25 are screwed into screw holes in the outer shell 11 to fix the shutter attaching member 22 to the outer shell 11 with screws. The shutter attaching member 22 can also be attached to the outer surface of the outer shell 11 by, e.g., adhesion with an adhesive, a double-sided tape, or the like.

As shown in FIGS. 4 and 5, a vent port 31 is formed in the shutter attaching member 22. A vent port 32 substantially corresponding to the vent port 31 is formed in the outer shell 11. A vent hole 33 substantially corresponding to the vent port 32 is formed in the impact-on-the-head absorbing liner 17 of the backing member 15 for the head. Accordingly, the vent ports 31 and 32 and vent hole 33 form a vent hole 34 which allows the inner surface of the impact-on-the-head absorbing liner 17 to communicate with the outer surface of the shutter attaching member 22. At part of the periphery of the vent port 31, the shutter attaching member 22 is integrally molded with a projecting piece portion 35 which projects substantially like a flat plate toward the outer shell 11. The projecting piece 35 is inserted in the vent port 32 of the outer shell 11 to position substantially the rear direction side of the shutter attaching member 22.

As shown in FIG. 5, the shutter member 21 has a pair of front and rear guide slits 36 and 37 which extend substantially in the back-and-forth direction. The shutter member 21 has, near one side edge of the front guide slit 36, an auxiliary slit 38 which extends substantially parallel to the front guide slit 36. The shutter member 21 has, between the front guide slit 36 and auxiliary slit 38, an elastically deformable bridge-like thin strip portion 41 which has a comparatively small width and extends substantially in the back-and-forth direction. The bridge-like thin strip 41 has, at its two, front and rear portions, curved portions 42 and 43 which are curved to project from the side of the front guide slit 36 toward the side of the auxiliary slit 38. The shutter attaching member 22 is provided with a pair of front and rear guide projection portions 44 and 45 to respectively oppose the pair of front and rear guide slits 36 and 37. The pair of front and rear guide projections 44 and 45 are respectively inserted in the slits 36 and 37 relatively slidably or movably so as not to come out from the pair of front and rear guide slits 36 and 37 of the shutter member 21. The front guide projection portion 44 can be held at positions by the curved portions 42 and 43 of the front guide slit 36. The shutter member 21 also has a shield plate portion 46 between its left edge portion (lower side in FIG. 5) and the auxiliary slit 38.

As shown in FIGS. 1, 2 and 5, the cover member 23 serving also as the air current deflecting member has a ridge portion 47 extending substantially in the back-and-forth direction substantially throughout the entire length of the cover member 23. As shown in FIG. 2, the ridge portion 47 gradually externally projects and rises from its front end 47*a* (the front end 47*a* is located substantially on the outer surface of the outer shell 11) toward its rear end 47*b* side until its top portion 47*c* and gradually descends and lowers from the top portion 47*c* toward the rear end 47*b* side until the rear end 47*b* (the rear end 47*b* is substantially located on the outer surface of the outer shell 11). The length from the front end 47*a* to the top portion 47*c* of the ridge portion 47 preferably falls within the range of two to four times the length from the top portion 47*c* to the rear end 47*b*. Consequently, the outer surface of the cover member 23 is formed with an air current deflecting surface 48 with a comparatively acute inclination on the left side (lower side in FIG. 5) of the ridge portion 47 and an air current deflecting surface 49 with a comparatively moderate inclination on the right side (upper side in FIG. 5) of the ridge portion 47. The cover member 23 has a tap slit 51 which extends in the air current deflecting surface 49 substantially in the back-and-forth direction. A manipulating tap portion 52 formed on the outer surface of the shutter member 21 by integral molding projects outside the cover member 23 through the tap slit 51. A recess 53 to catch the finger of the operator is formed at the center of the manipulating tap 52.

As shown in FIGS. 4 to 6, the air current deflecting surface 49 has a substantially U-shaped step portion 54 as a substantially two-way step portion which opens substantially backward to form a low-level surface 55 which is substantially surrounded by the substantially U-shaped step portion 54. The substantially U-shaped step portion 54 comprises a pair of left and right step portions 54*a* and 54*b* and a front step portion 54*c*. The width (in another word, height) of each of the pair of left and right step portions 54*a* and 54*b* gradually decreases from the front end toward the rear end, to form at the rear end a surface substantially level with the air current deflecting surface 49 excluding the low-level surface 55. The low-level surface 55 of the cover member 23 has a vent port 56 substantially corresponding to the vent port 31 of the shutter attaching member 22 so as to be adjacent to the front step portion 54*c* of the substantially U-shaped step portion 54. A gap substantially equal to or a gap (see FIG. 4) slightly larger than the thickness of the shield plate portion 46 of the shutter attaching member 22 is formed between the vent ports 56 and 31. Therefore, when the shield plate portion 46 is inserted in this gap (in other words, between the vent ports 31 and 56), it can shield the vent port 31 of the shutter attaching member 22.

As shown in FIG. 4, the cover member 23 is attached to the shutter attaching member 22. To attach the cover member 23, an engaging opening 57 is formed at substantially the center of the low-level surface 55 of the cover member 23. A substantially U-shaped engaging portion 58 is formed on that surface of the cover member 23 which is opposite (that is, the rear side) to the air current deflecting surface 49 (excluding the low-level surface 55). A male-hook-shaped engaging projection portion 61 is formed in a region comprising the rear end portion and its vicinity of the shutter attaching member 22. A substantially corner-shaped engaging portion 62 is formed in a region comprising the front end portion and its vicinity of the shutter attaching member 22 to substantially correspond to the substantially U-shaped engaging portion 58 of the cover member 23.

As shown in FIG. 5, the engaging opening 57 of the cover member 23 has an engaging hole 64 which can be substantially circular except for a gap (in other words, a broken portion or narrow portion) 63, and the gap 63. The gap 63 can be used to press the male-hook-shaped engaging projection portion 61 into the engaging hole 64 or to pull out the engaging projection portion 61 from the engaging hole 64, and is directed from the engaging hole 64 substantially to the front side of the head protecting body 2. In the embodiment shown in the drawings, a straight line $L_2$ which extends horizontally to be perpendicular to a straight line $L_1$ extending through the narrowest portion of the gap 63 extends substantially in the back-and-forth direction of the head protecting body 2. In other words, the angle formed by the straight line $L_2$ with respect to the back-and-forth direction of the head protecting body 2 is substantially 0°. In the present invention, from the viewpoint of practice, this angle falls generally preferably within an angle of ±30°, more preferably within an angle of ±20° and most preferably within an angle of ±10°. The engaging opening 57 can have a so-called substantially end-lug-hole shape (in other words, a shape formed by the small hole 64 and a large hole 65 that continue through the narrow gap 63). In the embodiment shown in the drawings, the comparatively large, substantially elliptic (that is, flat oval) hole 65 is formed which continues to the engaging hole 64, which can have a comparatively small diameter and be substantially circular, through the gap 63. On the upper side of the substantially elliptic hole 65 (in other words, a side opposite to the insertion side where the male-hook-shaped engaging projection 61 is to be inserted in the hole 65), an upwardly projecting cover portion 66 is provided which substantially forms a ¼ spindle shape (i.e., a shape which is obtained by halving a substantially spindle-shaped hollow body in both the major-axis direction (i.e., the longitudinal direction) and minor-axis direction (i.e., the direction of diameter) and almost forms a substantially semi-cylindrical shape). The cover portion 66 (particularly its inner surface) decreases both in its direction of height and widthwise direction so as to gradually taper from the gap 63 side of the substantially elliptic hole 65 toward the opposite side.

As shown in FIGS. 4 and 5, the substantially U-shaped engaging portion 58 of the cover member 23 is formed on that surface of the cover member 23, which is opposite to the air current deflecting surface 49, by integral molding. Hence, this surface on the opposite side and the substantially U-shaped engaging portion 58 form a substantially quadrangular engaging hole 67. The substantially corner-shaped engaging portion 62 of the shutter attaching member 22 comprises an upright portion 62*a* and a substantially flat plate-shaped engaging piece portion 62*b* which extends from the upper end of the upright portion 62*a* substantially backward to be substantially perpendicular to the upright portion 62*a*. When the cover member 23 moves substantially relatively forward with respect to the shutter attaching member 22, as shown in FIG. 4, the engaging piece portion 62*b* of the shutter attaching member 22 is relatively inserted in the substantially quadrangular engaging hole 67 of the cover member 23 in a direction substantially perpendicular to the engaging hole 67. The engaging piece portion 62*b* need not have a substantially flat plate-like shape but may have a substantially rod-like shape or another shape. The substantially square engaging hole 67 need not be a through hole the two ends of which in the substantially back-and-forth direction are open, but may be a blind hole a rear end side of which is closed.

In a simple plug-in recess-projection engaging mechanism with the above arrangement which comprises the substantially square engaging hole 67 and substantially corner-shaped engaging portion 62, as shown in FIG. 4, the engaging piece portion 62*b* is substantially relatively regulated in position substantially in the vertical direction and substantially in the horizontal direction by the substantially U-shaped engaging portion 58 and the opposite surface of the cover member 23. However, the engaging piece portion 62*b* is not substantially relatively regulated in position substantially in the back-and-forth direction except that the upright portion 62*a* abuts against the substantially U-shaped engaging portion 58 so the inserting amount is regulated. Therefore, the engaging piece portion 62*b* is relatively inserted into the substantially square engaging hole 67 very simply and very readily without substantially generating any load (in other words, reaction force). In the inserted state, the engaging piece portion 62*b* is pulled out from the engaging hole 67 relatively in a direction substantially perpendicular to the engaging hole 67 very simply and very readily without substantially generating any load (in other words, reaction force).

As shown in FIGS. 4 to 6, the male-hook-shaped engaging projection portion 61 of the shutter attaching member 22 is formed on an engaging projection member 71 which is formed separately from the shutter attaching member 22. The engaging projection member 71 comprises a base plate portion 72 which can be, e.g., a substantially square plate, the male-hook-shaped engaging projection portion 61 which is integrally molded with the base plate 72, and a hollow space 73 which can be substantially cylindrical and extends from the lower surface of the base plate 72 to near the upper end portion of the engaging projection 61. The male-hook-shaped engaging projection portion 61 comprises a comparatively small-diameter, substantially cylindrical narrow portion (in other words, small-diameter portion) 74 which extends from the base plate 72 substantially upward, and a comparatively large-diameter, substantially pot-lid-shaped cap portion (in other words, large-diameter portion) 75 continuous to the top end of the narrow portion 74, and can have a substantially cap-shaped hollow structure. Outer surfaces 75*a* and 75*b* at the upper and lower end portions, respectively, of the substantially pot-lid-shaped cap portion 75 can be chamfered to be rounded. In the embodiment of the drawings, as shown in FIG. 6, the outer surface 75*a* at the upper end portion of the cap portion 75 is chamfered comparatively large, and the outer surface 75*b* at the lower end of the cap portion 75 is chamfered comparatively small.

The engaging projection member 71 (particularly the engaging projection 61) shown in FIG. 6 can be made of a material with comparatively low flexural rigidity, e.g., ethylene-vinyl acetate copolymer resin (EVA), vinyl chloride, polyethylene, polyvinyl alcohol (PVA), polypropylene (PP), or another synthetic resin, synthetic rubber, or natural rubber.

In the present invention, from the viewpoint of practice, the flexural rigidity of the material that forms the engaging projection portion 61 (in other words, engaging projection member 71) is generally preferably equal to 100 MPa or less, more preferably falls within a range of 30 MPa to 80 MPa, and most preferably falls within a range of 40 MPa to 60 MPa.

The shutter attaching member 22 shown in FIGS. 4 to 6 has an attaching opening 76 at a position substantially corresponding to the male-hook-shaped engaging projection 61. The shutter attaching member 22 also has a thin bulge portion 77, e.g., a circular bulge portion, around the outer surface of the attaching opening 76. As shown in FIG. 4, the attaching opening 76 has a step portion and comprises a comparatively large lower attaching opening 76*a* on the inner surface side of the shutter attaching member 22 and a comparatively small upper attaching opening 76*b* on the outer surface side of the shutter attaching member 22. The upper attaching opening 76*b* continues to the lower attaching opening 76*a* through the step portion described above.

The lower attaching opening 76*a* of the shutter attaching member 22 shown in FIGS. 4 to 6 can have a shape substantially equal to or s little larger than that of the base plate portion 72 of the engaging projection member 71. When the engaging projection member 71 is to be attached to the shutter attaching member 22, the base plate portion 72 is inserted in the lower attaching opening 76*a* from below comparatively loosely, or comparatively tightly. A distance $L_3$ between the two opposing sides of the lower attaching opening 76*a*, which can be substantially square, of the shutter attaching member 22 can be slightly smaller than a diameter $L_4$ of the maximal diameter portion, which can be substantially circular when seen from the top, of the cap portion (in other words, large-diameter portion) 75 of the male-hook-shaped engaging projection portion 61 of the engaging projection member 71. Therefore, when the engaging projection member 71 is to be attached to the shutter attaching member 22, the male-hook-shaped engaging projection 61 is forced and pressed into the upper attaching opening 76*b* from below through the lower attaching opening 76*a*, so it moves upward in the opening 76*b*. As shown in FIG. 4, when the narrow portion 74 of the engaging projection portion 61 is held in position by the surrounding portion of the upper attaching opening 76*b* and the cap portion 75 projects upward from the outer surface of the shutter attaching member 22, the engaging projection member 71 is attached to and held by the shutter attaching member 22.

A diameter $L_5$ of the engaging hole 64 (the engaging hole 64 can be substantially circular except for the gap 63) of the engaging opening 57 of the cover member 23 shown in FIGS. 4 to 6 can be substantially equal to or slightly smaller than a diameter $L_6$ of the narrow portion 74 of the male-hook-shaped engaging projection 61 of the engaging projection member 71. A length $L_7$ of the narrowest portion of the gap 63 of the engaging opening 57 is smaller than the diameter $L_6$ (in other words, the diameter $L_5$) of the narrow portion 74 of the male-hook-shaped engaging projection 61 by a certain degree. In the embodiment shown in the drawings, the length $L_7$ is about 80% each of the diameters $L_6$ and $L_5$. In the present invention, from the viewpoint of practice, the length $L_7$ generally preferably falls within a range of 57.5% to 95% each of the diameters $L_6$ and $L_5$, more preferably within a range of 65% to 90%, and most preferably within a range of 72.5% to 85%.

The press-in recess-projection engaging mechanism having the above arrangement comprising the substantially end-lug-hole-shaped engaging opening 57 and male-hook-shaped engaging projection 61 is arranged on the head protecting body 2 to be substantially in-line in the back-and-forth direction of the head protecting body 2 with the simple plug-in recess-projection engaging mechanism described above. If the male-hook-shaped engaging projection 61 is relatively inserted in the substantially elliptic hole 65 of the substantially end-lug-hole-shaped engaging opening 57 from below and thereafter the substantially cylindrical narrow portion 74 of the engaging projection portion 61 is relatively pressed into the substantially circular engaging hole 64 in a direction substantially horizontal to the engaging hole 64 through the gap (in other words, narrow portion) 63 of the engaging opening 57, the narrow portion 74 of the engaging projection 61 can be relatively fitted in the engaging hole 64. The narrow portion 74 can also be engaged with the engaging hole 64 by relatively pressing the male-hook-shaped engaging projection 61 into the substantially circular engaging hole 64 from below (in other words, in a direction substantially perpendicular to the engaging hole 64) with a strong force.

(2) Operation of Head Rear Ventilator Mechanism

The shutter member 21, shutter attaching member 22 and cover member 23 can be attached to the head protecting body 2 in the following manner.

First, the front and rear guide projection portions 44 and 45 of the shutter attaching member 22, to which the engaging projection member 71 has already been attached as shown in FIG. 5, are relatively pressed into the front and rear guide slits 36 and 37, respectively, of the shutter member 21, to attach the shutter member 21 to the shutter attaching member 22. In this case, as the heads of the guide projection portions 44 and 45 are large like screw heads, they will not easily come out of the guide slits 36 and 37. The base plate portion 72 of the engaging projection member 71 is fixed firmly as it is clamped between the outer shell 11 and shutter attaching member 22. Subsequently, the shutter attaching member 22 with the shutter member 21 is screwed into and fixed to the outer shell 11 with the attaching screws 26 and 27, thereby attaching the shutter attaching member 22 and shutter member 21 to the head protecting body 2. Alternatively, the shutter attaching member 22 may be screwed into and fixed to the outer shell 11 with the attaching screws 26 and 27 first, and after that the shutter member 21 may be attached to the shutter attaching member 22 in the same manner as in the case described above.

Subsequently, the upper sides of the shutter attaching member 22 and shutter member 21 shown in FIG. 5 are covered with the cover member 23. In this case, the male-hook-shaped engaging projection portion 61 of the shutter attaching member 22 is relatively inserted in the substantially elliptic hole portion (in other words, a comparatively large engaging auxiliary hole) 65 of the substantially end-lug-hole-shaped engaging opening 57 of the cover member 23 from below (in other words, in a direction substantially perpendicular to the hole 65). Simultaneously, the engaging piece portion 62*b* of the substantially corner-shaped engaging portion 62 of the shutter attaching member 22 is set to substantially oppose the substantially quadrangular engaging hole 67 which is formed of the substantially U-shaped engaging portion 58 or the like of the cover member 23. Then, the cover member 23 is moved relatively forward with respect to the head protecting body 2 (in other words, the shutter attaching member 22 and shutter member 21). With this movement, the substantially cylindrical narrow portion 74 of the male-hook-shaped engaging projection 61 of the shutter attaching member 22 is relatively pressed into the substantially circular engaging hole 64 in a direction substantially horizontal to the engaging hole 64 through the gap 63 of the engaging opening 57, so the narrow portion 74 of the engaging projection 61 relatively fits in the engaging hole 64. Simultaneously, the engaging piece portion 62*b* of the shutter attaching member 22 is relatively inserted in the substantially quadrangular engaging hole 67 of the cover member 23 in a direction substantially perpendicular to the engaging hole 67 (that is, in the direction of depth of the engaging hole 67, in other words, substantially in the planar direction of the head protecting body 2 which is a direction substantially backward from substantially the front). In this case, the relative moving direction of the engaging projection 61 with respect to the cover member 23 and the relative moving direction of the engaging piece portion 62*b* are substantially equal (that is, substantially backward). Thus, the cover member 23 can be attached to and held at its two portions by the shutter attaching member 22 with the press-in recess-projection engaging mechanism and the plug-in recess-projection engaging mechanism.

If the wearer puts on the full-face-type helmet 1 comprising the pair of left and right head rear ventilator mechanisms 16*a* and 16*b* having the above arrangement and drives on an unpaved road or wasteland on a motorcycle, the head rear ventilator mechanisms 16*a* and 16*b* serve in the following manner. Namely, the traveling wind (that is, external air) flowing relatively along the outer surface of the outer shell 11 is relatively directed toward the back head region through the vertex region of the outer shell 11, and is accordingly deflected relatively by the air current deflecting surfaces 48 and 49 of the cover members 23 of the head rear ventilator mechanisms 16*a* and 16*b* and shifts relatively backward along the outer surface of the outer shell 11 while substantially maintaining its laminar flow. As laminar traveling winds that are substantially even on the left and right sides of the outer shell 11 flow along the outer surface of the outer shell 11, left-to-right shaking of the head protecting body 2 can be prevented. Consequently, the wearer can readily hold the head protecting body 2 as it is opposed to the traveling direction of the motorcycle.

The wearer can hook his or her finger in the recess 53 of the manipulating tap portion 52 of the shutter member 21 to reciprocate the shutter member 21 substantially in the back-and-forth direction with respect to the shutter attaching member 22. In a state wherein the vent port 31 of the shutter attaching member 22 is shielded with the shield plate portion 46 of the shutter member 21, if the shutter member 21 is moved forward to open the vent port 31, air in the interior of the head protecting body 2 can be exhausted outside in the following manner. More specifically, when the shield plate portion 46 of the shutter member 21 opens the vent port 31 of the shutter attaching member 22, the vent hole 34 communicates with the outside through the vent port 56. When the traveling wind flows relatively backward along the air current deflecting surface 49 of the cover member 23, as described above, a negative pressure is generated near the outer surface of the vent port 56 of the cover member 23 due to the presence of the step portion 54. Hence, air in the vent hole 34 (and accordingly in the interior of the head protecting body 2) is forcedly discharged outside through the vent port 56 serving as an exhaust port.

When the wearer wearing the full-face-type helmet 1 drives on an unpaved road or wasteland on the motorcycle, an unforeseen circumstance such as a fall of the motorcycle may occur. In this case, the wearer is thrown off onto the unpaved road or wasteland substantially in the driving direction. Therefore, the head protecting body 2 (particularly at least one of the upper portion of the back head region, the upper portions of the two, left and right side head regions, the rear portion of the vertex region and the like) of the helmet 1 desirably skids on the ground surface of the unpaved road or the wasteland substantially in the driving direction to moderate the degree of injury of the wearer. When the head protecting body 2 is to skid on the ground surface or the like substantially in the driving direction, the projecting portion (i.e., the ridge portion 47, step portion 54, or the like) of the cover member 23 of the left- or right-side head rear ventilator mechanism 16*a* or 16*b* may catch on the ground surface or the like (i.e., the ground surface or another foreign substance).

In this case, usually, a force (in other words, an impact) from the ground surface or the like relatively acts on the cover member 23 substantially backward with respect to the head protecting body 2. If this force is large to a certain degree, the male-hook-shaped engaging projection 61 fitted in the substantially circular engaging hole 64 of the substantially end-lug-hole-shaped engaging opening 57 relatively moves substantially forward through the gap 63. Simultaneously, the engaging piece portion 62*b* of the shutter attaching member 22 relatively disengages forward from the substantially quadrangular engaging hole 67 of the cover member 23. In this case, the relative moving direction of the engaging projection 61 with respect to the cover member 23 and the relative moving direction of the engaging piece portion 62*b* with respect to the cover member 23 are substantially the same (that is, substantially forward). When a very large force (in other words, a very large impact) acts on the cover member 23 or shutter attaching member 22, it may break the substantially corner-shaped engaging portion 62 and/or substantially U-shaped engaging portion 58, so the engaging piece portion 62*b* may disengage from the substantially quadrangular engaging hole 67.

Therefore, the cover member 23 is separated and removed from the shutter attaching member 22 (accordingly the head protecting body 2). Even when the cover member 23 catches on the ground surface or the like, the head protecting body 2 smoothly skids on the ground surface or the like substantially in the driving direction of the motorcycle. In this case, when the engaging projection 61 relatively moves substantially forward as described above, the upper surface and its vicinity of the cap portion 75 of the engaging projection 61 move relatively forward along the inner surface of the cover portion 66, which substantially forms a ¼ spindle, of the cover member 23. Hence, the cover member 23 is pushed up by the cap portion 75 and relatively suspended from the shutter attaching member 22, so the cover member 23 can relatively separate upward from the shutter attaching member 22. If the cover member 23 receives a large force in the substantially upward or downward direction shown in FIG. 5 that acts on the shutter attaching member 22, or if the large force has a component in a direction substantially perpendicular to the planar direction of the shutter attaching member 22, the male-hook-shaped engaging projection 61 is cut off at its substantially cylindrical narrow portion 74 so the cap portion 75 may be torn off, or if not torn off, may deform elastically. Then, the male-hook-shaped engaging projection 61 may be pulled out substantially downward from the substantially circular engaging hole 64. Conversely, when attaching the cover member 23 to the shutter attaching member 22, the wearer can press the engaging projection 61 into the substantially circular engaging hole 64 substantially from below with a large force.

Having described a specific preferred embodiment of this invention with reference to the accompanying drawings, it is to be understood that the invention is not limited to that precise embodiment, and that various changes and modifications may be effected therein by one skilled in the art without departing from the scope or spirit of the invention as defined in the appended claims.

For example, in the above embodiment, each of the left- and right-side head rear ventilator mechanisms 16*a* and 16*b* is provided with the press-in recess-projection engaging mechanisms 61 and 64 and the simple plug-in recess-projection engaging mechanisms 62 and 67. Alternatively, a second press-in recess-projection engaging mechanism having substantially the same arrangement as that of the press-in recess-projection engaging mechanisms 61 and 64 can be provided in place of the simple plug-in recess-projection engaging mechanisms 62 and 67. Also, in place of the simple plug-in recess-projection engaging mechanisms 62 and 67, another attaching mechanism may be provided with which when a large force (in other words, a large impact) acts on the cover member 23 and shutter attaching member 22, at least one of the attaching means of the cover member 23 side and the attaching means of the shutter attaching member 22 side is broken, so the attaching means disengage from each other.

In the above embodiment, the male-hook-shaped engaging projection 61 is provided to the shutter attaching member 22, and the engaging hole 64 having the gap 63 is formed in the cover member 23. Conversely, the male-hook-shaped engaging projection 61 can be provided to the cover member 23, and the engaging hole 64 having the gap 63 can be formed in the shutter attaching member 22. In this case, the front and rear positions of the press-in recess-projection engaging mechanisms 61 and 64 may be inversed.

In the above embodiment, the substantially corner-shaped engaging portion 62 is provided to the shutter attaching member 22, and the substantially quadrangular engaging hole 67 is formed in the cover member 23. Conversely, the substantially corner-shaped engaging portion 62 can be provided to the cover member 23, and the substantially quadrangular engaging hole 67 can be formed in the shutter attaching member 22. In this case, the front and rear positions of the simple plug-in recess-projection engaging mechanisms 62 and 67 may be inverted.

In the above embodiment, in each of the left- and right-side head rear ventilator mechanisms 16*a* and 16*b*, the simple plug-in recess-projection engaging mechanisms 62 and 67 are located substantially in front of the press-in recess-projection engaging mechanisms 61 and 64, respectively. Conversely, in either one or both of the left- and right-side head rear ventilator mechanisms 16*a* and 16*b*, the press-in recess-projection engaging mechanisms 61 and 64 may be located, e.g., substantially in front of the simple plug-in recess-projection engaging mechanisms 62 and 67.

In the above embodiment, one pair of left and right head rear ventilator mechanisms 16*a* and 16*b* each provided with the simple plug-in recess-projection engaging mechanisms 62 and 67 and the press-in recess-projection engaging mechanisms 61 and 64 are provided to the head protecting body 2. Alternatively, only one head rear ventilator mechanism provided with the simple plug-in recess-projection engaging mechanisms 62 and 67 and the press-in recess-projection engaging mechanisms 61 and 64 may be provided at, e.g., substantially the center in the left-to-right direction of the head protecting body 2. In this case, the single head rear ventilator mechanism can be formed substantially axi-symmetrically.

In the above embodiment, the left- and right-side ventilator mechanisms 16*a* and 16*b* are provided to the head rear region. Alternatively, the ventilator mechanisms 16*a* and 16*b* may be respectively provided to the head central/rear region, in the same manner as in the full-face-type helmet of U.S. Pat. No. 6,263,513 described above. Also, the ventilator mechanisms 16*a* and 16*b* may be provided to a region including at least one of the head central/rear region, the upper portions of the two, left and right side head regions, front head region and the like.

In the above embodiment, the vent port 31 which is openably/closeably shielded by the shield plate portion 46 of the shutter member 21 serves as an exhaust port. Alternatively, the vent port 31 can be formed to serve as an air supply port. Depending on the case, the vent port 31 can be formed to serve as an air supply port/exhaust port.

In the above embodiment, the shutter member 21 is formed to be linearly reciprocal. Alternatively, the shutter member 21 may be formed to be reciprocally pivotal or capable of another reciprocal movement.

In the above embodiment, the vent port 31 formed in the shutter attaching member 22 is openably/closeably shielded by the shield plate portion 46 of the shutter member 21. Alternatively, the shield plate portion 46 of the shutter member 21 can openably/closeably shield not the vent port 31 but directly the vent port 32 directly formed in the outer shell 11, or the vent port 56 formed in the cover member 23 from inside or the like.

In the above embodiment, the cover member 23 also serves as an air current deflecting member. The cover member 23 need not serve also as an air current deflecting member. Conversely, the member 23 may not have the function of the cover member but may have only the function of the air current deflecting member.

In the above embodiment, each of the left- and right-side head rear ventilator mechanisms 16*a* and 16*b* is provided with the substantially U-shaped step portion 54. The step portion 54 need not be substantially U-shaped, but may form a two-way step such as a substantially V-shaped step. The step portion 54 may also serve as a projecting ridge portion which projects from the air current deflecting surface 49 and/or ridge portion 47 upward by a predetermined degree.

In the above embodiment, a shield plate that can open/close the window opening 3 is omitted. When necessary, such a shield plate can be pivotally attached to the head protecting body 2 with an attaching screw (not shown) or the like.

In the above embodiment, the present invention is applied to the off-road driving full-face-type helmet 1. The present invention can also be applied to a full-face-type helmet (e.g., an ordinary helmet) other than an off-road driving helmet.

In the above embodiment, the present invention is applied to the full-face-type helmet 1. The present invention can also be applied to another type of helmet, e.g., a jet-type helmet, a semi-jet-type helmet, or a full-face-type helmet serving also as a jet-type helmet with a chin portion that can be raised.

The invention claimed is:

1. A helmet comprising:

a head protecting body to be worn on a head of a helmet wearer to protect the head, said head protecting body being provided with a ventilator mechanism to ventilate an interior of said head protecting body, and at least one ventilator mechanism comprising a shutter member to open/close a vent hole, a shutter attaching member which is attached to an outer surface of said head protecting body so as to attach and hold said shutter member reciprocally, and a cover member which is attached to said shutter attaching member with a plurality of attaching mechanisms so as to cover said shutter member and said shutter attaching member, wherein said at least one of said plurality of attaching mechanisms comprises a recess-projecting engaging mechanism including an engaging projection portion and an engaging hole having a gap, and said engaging projection portion is configured to be relatively pressed into said gap and then relatively inserted and held in said engaging hold through said gap, wherein said engaging projection portion is formed on said shutter attaching member, and said engaging hole is formed in said cover member, wherein at least another one of said plurality of attaching mechanism comprises a simple plug-in recess-projection engaging mechanism including a second engaging projection portion and a second engaging hole in which said second engaging projection portion is to be relatively inserted and held, said second engaging projection portion which is relatively inserted and held in said second engaging hole is configured to readily come out from said second engaging hole substantially in a direction of depth of said second engaging hole, and said second engaging projection portion is configured to relatively come out from said second engaging hole substantially in the same direction as a direction in which said engaging projection portion relatively comes out from said engaging hole through said gap.

2. A helmet according to claim 1, wherein said plurality of attaching mechanism comprise two attaching mechanisms, one of said two attaching mechanism comprises said recess-projection engaging mechanism having said engaging projection portion and said engaging hole, and a remaining one of said two attaching mechanism comprises said simple plug-in recess-projection engaging mechanism.

3. A helmet comprising:

a head protecting body to be worn on a head of a helmet wearer to protect the head, said head protecting body being provided with a ventilator mechanism to ventilate an interior of said head protecting body, and at least one ventilator mechanism comprising a shutter member to open/close a vent hole, a shutter attaching member which is attached to an outer surface of said head protecting body so as to attach and hold said shutter member reciprocally, and a cover member which is attached to said shutter attaching member with a plurality of attaching mechanisms so as to cover said shutter member and said shutter attaching member, wherein said at least one of said plurality of attaching mechanisms comprises a recess-projection engaging mechanism including an engaging projection portion and an engaging hole having a gap, and said engaging projection portion is configured to be relatively pressed into said gap and then relatively inserted and held in said engaging hole through said gap, wherein said engaging projection portion is formed on said shutter attaching member, and said engaging hole is formed in said cover member, wherein said cover member has a substantially end-lug-hole-shaped engaging opening comprising said engaging hole, said gap, and an engaging auxiliary hole which continues to said engaging hole through said gap and is larger than said engaging hole, said cover member has a cover portion which covers said engaging auxiliary hole, and an inner surface of said cover portion decreases to gradually taper from said gap side of said engaging auxiliary hole toward an opposite side.

4. A helmet according to claim 3, wherein said cover portion substantially forms a ¼ spindle shape which can be obtained by halving a substantially spindle-shaped hollow body in both a longitudinal direction and a direction of diameter.

5. A helmet comprising:

a head protecting body to be worn on a head of a helmet wearer to protect the head, said head protecting body being provided with a ventilator mechanism to ventilate an interior of said head protecting body, and at least one ventilator mechanism comprising a shutter member to open/close a vent hole, a shutter attaching member which is attached to an outer surface of said head protecting body so as to attach and hold said shutter member reciprocally, and a cover member which is attached to said shutter attaching member with a plurality of attaching mechanisms so as to cover said shutter member and said shutter attaching member, wherein said at least one of said plurality of attaching mechanisms comprises a recess-projection engaging mechanism including an engaging projection portion and an engaging hole having a gap, and said engaging projection portion is configured to be relatively pressed into said gap and then relatively inserted and held in said engaging hole through said gap, wherein said engaging projection portion is formed on said shutter attaching member, and said engaging hole is formed in said cover member, wherein said engaging projection portion forms a male-hook-like shape.

6. A helmet comprising:

a head protecting body to be worn on a head of a helmet wearer to protect the head, said head protecting body being provided with a ventilator mechanism to ventilate an interior of said head protecting body, and at least one ventilator mechanism comprising a shutter member to open/close a vent hole, a shutter attaching member which is attached to an outer surface of said head protecting body so as to attach and hold said shutter member reciprocally, and a cover member which is attached to said shutter attaching member with a plurality of attaching mechanisms so as to cover said shutter member and said shutter attaching member, wherein said at least one of said plurality of attaching mechanisms comprises a recess-projection engaging mechanism including an engaging projection portion and an engaging hole having a gap, and said engaging projection portion is configured to be relatively pressed into said gap and then relatively inserted and held in said engaging hole through said gap, wherein said engaging projection portion is formed on said shutter attaching member, and said engaging hole is formed in said cover member, wherein said engaging projection portion has a hollow structure.

7. A helmet comprising:

a head protecting body to be worn on a head of a helmet wearer to protect the head, said head protecting body being provided with a ventilator mechanism to ventilate an interior of said head protecting body, and at least one ventilator mechanism comprising a shutter member to open/close a vent hole, a shutter attaching member which is attached to an outer surface of said head protecting body so as to attach and hold said shutter member reciprocally, and an air current deflecting member which is attached to said shutter attaching member with a plurality of attaching mechanisms so as to relatively deflect an air current flowing relatively along said outer surface of said head protecting body, thereby stabilizing said head protecting body, wherein said at least one of said plurality of attaching mechanisms comprises a recess-projection engaging mechanism including an engaging projection portion and an engaging hole having a gap, and said engaging projection portion is configured to be relatively pressed into said gap and then relatively inserted and held in said engaging hole through said gap, wherein at least another one of said plurality of attaching mechanisms comprises a simple plug-in recess-projection engaging mechanism including a second engaging projection portion and a second engaging hole in which said second engaging projection portion is to be relatively inserted and held, said second engaging projection portion which is relatively inserted and held in said second engaging hole is configured to readily come out from said second engaging hole substantially in a direction of depth of said second engaging hole, and said second engaging projection portion is configured to relatively come out from said second engaging hole substantially in the same direction as a direction in which said engaging projection portion relatively comes out from said engaging hole through said gap.

8. A helmet according to claim 7, wherein said plurality of attaching mechanisms comprise two attaching mechanisms, one of said two attaching mechanisms comprises said recess-projection engaging mechanism having said engaging projection and said engaging hole, and a remaining one of said two attaching mechanisms comprises a said simple plug-in recess-projection engaging mechanism.

9. A helmet according to claim 7, wherein said air current deflecting member has a ridge portion extending substantially in a back-and-forth direction substantially throughout an entire length of said air current deflecting member.

10. A helmet according to claim 7, wherein said air current deflecting member has a substantially two-way step portion which substantially opens backward.

11. A helmet according to claim 10, wherein said substantially two-way step portion comprises a substantially U-shaped step portion.

12. A helmet according to claim 10, wherein said air current deflecting member further comprises a low-level surface which is substantially surrounded by said two-way step portion, and said low-level surface has a vent port corresponding to said vent hole.

13. A helmet according to claim 12, wherein said cover portion is formed on said low-level surface substantially behind said vent port.

14. A helmet comprising:

a head protecting body to be worn on a head of a helmet wearer to protect the head, said head protecting body being provided with a ventilator mechanism to ventilate an interior of said head protecting body, and at least one ventilator mechanism comprising a shutter member to open/close a vent hole, a shutter attaching member which is attached to an outer surface of said head protecting body so as to attach and hold said shutter member reciprocally, and an air current deflecting member which is attached to said shutter attaching member with a plurality of attaching mechanisms so as to relatively deflect an air current flowing relatively along said outer surface of said head protecting body, thereby stabilizing said head protecting body, wherein said at least one of said plurality of attaching mechanisms comprises a recess-projection engaging mechanism including an engaging projection portion and an engaging hole having a gap, and said engaging projection portion is configured to be relatively pressed into said gap and then relatively inserted and held in said engaging hole through said gap, wherein said air current deflecting member has a substantially end-lug-hole-shaped engaging opening comprising said engaging hole, said gap, and an engaging auxiliary hole which continues to said engaging hole through said gap and is larger than said engaging hole, said air current deflecting member has a cover portion which covers said engaging auxiliary hole, and an inner surface of said cover portion decreases to gradually taper from said gap side of said engaging auxiliary hole toward an opposite side.

15. A helmet according to claim 14, wherein said cover portion substantially forms a ¼ spindle shape which can be obtained by halving a substantially spindle-shaped hollow body in both a longitudinal direction and a direction of diameter.

16. A helmet comprising:

a head protecting body to be worn on a head of a helmet wearer to protect the head, said head protecting body being provided with a ventilator mechanism to ventilate an interior of said head protecting body, and at least one ventilator mechanism comprising a shutter member to open/close a vent hole, a shutter attaching member which is attached to an outer surface of said head protecting body so as to attach and hold said shutter member reciprocally, and an air current deflecting member which is attached to said shutter attaching member with a plurality of attaching mechanisms so as to relatively deflect an air current flowing relatively along said outer surface of said head protecting body, thereby stabilizing said head protecting body, wherein said at least one of said plurality of attaching mechanisms comprises a recess-projection engaging mechanism including an engaging projection portion and an engaging hole having a gap, and said engaging projection portion is configured to be relatively pressed into said gap and then relatively inserted and held in said engaging hole through said gap, wherein said engaging projection portion forms a male-hook-like shape.

17. A helmet comprising:

a head protecting body to be worn on a head of a helmet wearer to protect the head, said head protecting body being provided with a ventilator mechanism to ventilate an interior of said head protecting body, and at least one ventilator mechanism comprising a shutter member to open/close a vent hole, a shutter attaching member which is attached to an outer surface of said head protecting body so as to attach and hold said shutter member reciprocally, and an air current deflecting member which is attached to said shutter attaching member with a plurality of attaching mechanisms so as to relatively deflect an air current flowing relatively along said outer surface of said head protecting body, thereby stabilizing said head protecting body, wherein said at least one of said plurality of attaching mechanisms comprises a recess-projection engaging mechanism including an engaging projection portion and an engaging hole having a gap, and said engaging projection portion is configured to be relatively pressed into said gap and then relatively inserted and held in said engaging hole through said gap, wherein said engaging projection portion has a hollow structure.

* * * * *